US006666389B2

(12) United States Patent
Ito et al.

(10) Patent No.: US 6,666,389 B2
(45) Date of Patent: Dec. 23, 2003

(54) FUEL INJECTION VALVE

(75) Inventors: Yoshihiko Ito, Nisshin (JP); Masaaki Konishi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/113,949

(22) Filed: Apr. 2, 2002

(65) Prior Publication Data

US 2002/0139873 A1 Oct. 3, 2002

(30) Foreign Application Priority Data

Apr. 2, 2001 (JP) ..... 2001-103270

(51) Int. Cl.[7] ..... F02M 51/00

(52) U.S. Cl. ..... 239/585.1; 239/583; 239/584; 239/585.2; 239/585.3; 239/585.4; 239/585.5

(58) Field of Search ..... 239/585.1, 585.2, 239/585.3, 585.4, 585.5, 583, 584

(56) References Cited

U.S. PATENT DOCUMENTS 5,236,174 A * 8/1993 Vogt et al. ..... 239/585.5
5,373,992 A * 12/1994 Reiter ..... 239/585.4
5,518,185 A * 5/1996 Takeda et al. ..... 239/585.4
5,762,272 A * 6/1998 Tani et al. ..... 239/585.4
5,944,262 A 8/1999 Akutagawa et al.

* cited by examiner

*Primary Examiner*—Robin O. Evans
(74) *Attorney, Agent, or Firm*—Nixon & Vanderhye P.C.

(57) ABSTRACT

In a fuel injection valve having a housing pipe, a valve movable reciprocatingly and axially inside the housing pipe, and a body valve having a bottom wall constituting a valve seat with which the valve comes in contact and a side wall whose axial end is connected to a circumferential periphery of the bottom wall and whose the other axial end is fitted to and heat bonded to an end of the housing pipe, the side wall is provided on an outer circumference thereof with a ring shaped groove that is formed in advance before the body valve and the housing pipe are heat bonded to each other and serves to prevent a deformation of the side wall due to heat generated by the heat bonding from being transmitted straight to the valve seat.

7 Claims, 4 Drawing Sheets

FUEL INJECTION VALVE

CROSS REFERENCE TO RELATED APPLICATION

This application is based upon and claims the benefit of priority of Japanese Patent Application No. 2001-103270 filed on Apr. 2, 2001, the content of which is incorporated herein by reference.

BACKGROUND OF THE INVENTION

1. Field of the Invention

The present invention relates to a fuel injection valve, in particular, a fuel injector for supplying fuel to a cylinder head or an intake manifold of a vehicle engine.

2. Description of Related Art

Conventionally, a fuel injection valve has been used for injecting and supplying fuel such as gasoline or light oil to a cylinder head of an engine. As shown in FIG. 6, the fuel injection valve 100 is provided at a lower part thereof with a housing pipe 101, a body valve 102 and an injection hole plate 103, as main components.

A valve needle 106 is inserted into an inner circumference of the housing pipe 101, which is formed in a hollow cylinder shape. An upper end of the body valve 102 is inserted into a lower end opening of the housing pipe 101. Circumferential surfaces of the housing pipe 101 and the body valve 102 in contact with each other are provided with a bonding portion 104 (as meshed in FIG. 6) formed by laser welding. The body valve 102 is formed in a hollow cylindrical shape. The body valve 102 is provided at an inner circumference thereof with a taper surface, whose diameter is smaller toward a lower end thereof, constituting a valve seat 105. The injection hole plate 103 is bonded to the lower end of the valve body 102. The injection hole plate 103, which is formed in a cup shape, is provided at a bottom wall thereof with injection holes 107.

When the valve needle 106, which is moved up and down reciprocatingly, is seated on the valve seat 105 of the valve needle 106, fuel is shut off. Accordingly, with respect to the valve seat 105, higher dimensional accuracy such as roundness accuracy and lower deformation are required.

However, the valve seat 105 of the conventional fuel injection valve 100 tends to be largely deformed, when the body valve 102 is bonded by laser welding to the lower end of the housing pipe 101.

The laser welding is performed in such a manner that, after the upper end of the body valve 102 is inserted into and comes in contact with the lower end of the housing pipe 101, laser beam is radiated so as to draw a circle from an outer circumferential side of the housing pipe 101 to circumferential surfaces of the body valve 102 and the housing pipe 101 in contact with each other. Welding heat is generated so as to draw a circle that follows a circular movement of the laser beam. The bonding portion 104 of the body valve 102 is sequentially heated and expands from time to time when the laser beam is radiated and, then, cooled and contracts. Since the welding heat is not uniformly generated, the body valve 102 in a vicinity of the bonding portion 104 is likely to be deformed so that the deformation thereof causes a deformation of the valve seat 105. In particular, when the deformation of the body valve 102 in a vicinity of the bonding portion 104 is not uniform circumferentially, the deformation of the valve seat 105 is more distinctive, which results in lowering a dimensional accuracy of the valve seat 105.

The lower dimensional accuracy of the valve seat 105, which is due to heat generating at the bonding portion 104, is caused by any heat bonding such as brazing, too.

The lower dimensional accuracy of the valve seat 105 causes a gap between the valve needle 106 and the valve seat 105 at a valve closing time and tends to leak fuel from the gap. Accordingly, C—H chemical compounds such as $CH_4$, that is, HC contents, in exhaust gas is likely to increase.

SUMMARY OF THE INVENTION

An object of the invention is to provide a fuel injection valve having a valve seat whose deformation due to bonding heat is smaller so that dimensional accuracy thereof is higher.

To achieve the above object, in a fuel injection valve having a housing pipe, a valve movable reciprocatingly and axially inside the housing pipe, and a body valve having a bottom wall constituting a valve seat with which the valve comes in contact and a side wall whose axial end is connected to a circumferential periphery of the bottom wall and whose the other axial end is fitted to and heat bonded to an end of the housing pipe, for example, by welding, the side wall is provided midway between the axial end and the other axial end thereof with a recess that is formed in advance before the body valve and the housing pipe are heat bonded to each other and serves to prevent a deformation of the side wall due to heat generated by the heat bonding from being straight transmitted to the valve seat.

Since the recess is provided in the side wall of the body valve, a deformation of the body valve due to heat generated by the heat bonding is partly absorbed by the recess so as not to transmit straight to the valve seat. Accordingly, the heat bonding does not lower a dimensional accuracy of the valve seat so much.

It is preferable that the recess is a ring shaped groove formed on an outer circumference of the side wall. The ring shaped groove serves to absorb a deformation of the body valve caused by press fitting the body valve to the housing pipe, since a bottom wall of the groove is operative like a plate spring.

More preferably, the ring shaped groove is located in a vicinity of a place where the body valve and the housing pipe are heat bonded to each other. In this case, a deformation area of the body valve between the ring shaped groove and the housing pipe is relatively small so that the ring shaped groove may effectively absorb the deformation.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
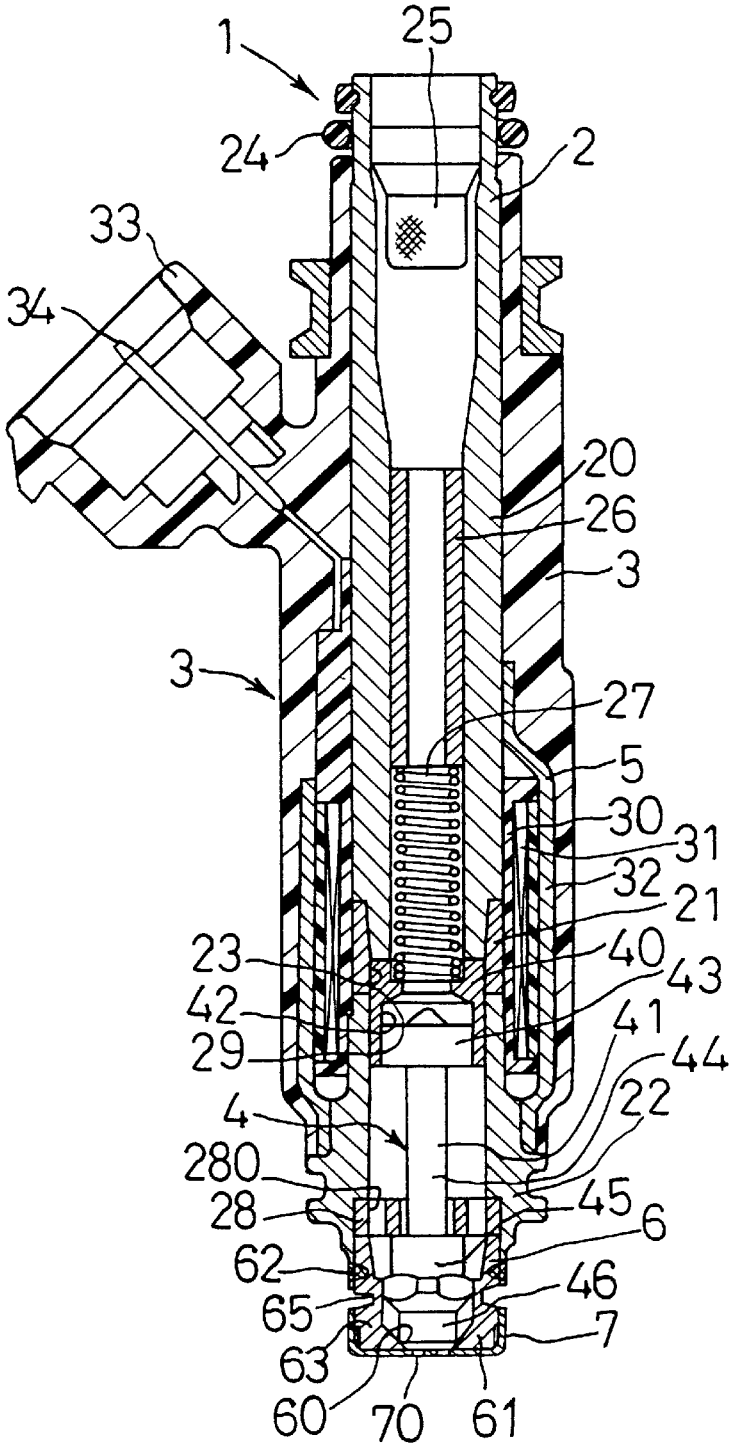
FIG. 1 is a cross sectional view of a fuel injection valve according to an embodiment of the present invention.
Figure 2:
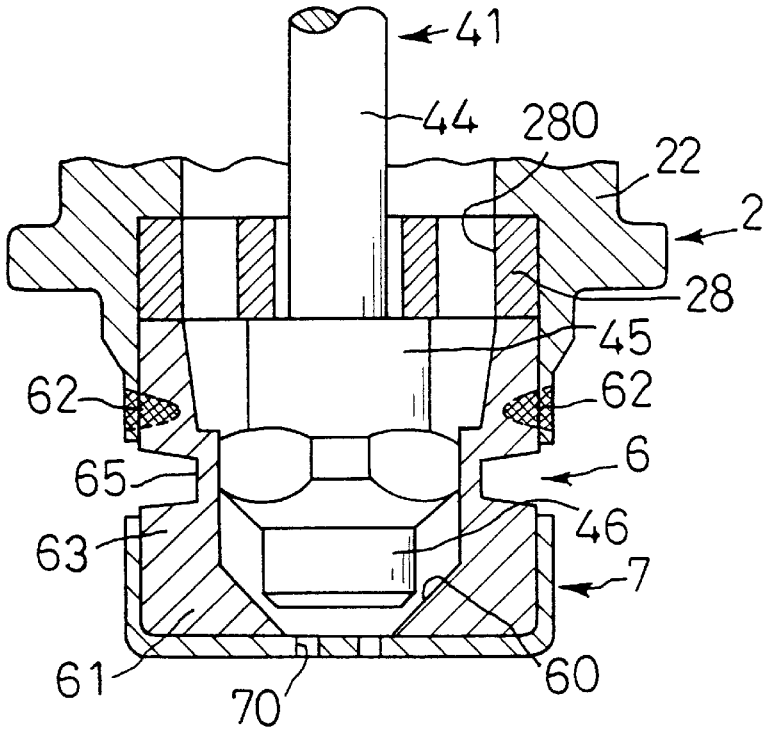
FIG. 2 is a partly enlarged view of the fuel injection valve of FIG. 1.

A preferred embodiment of the present invention is described with reference to FIGS. 1 and 2. A fuel injection valve 1 according to the present embodiment is mounted in an intake manifold in a vehicle engine. The fuel injection valve 2 may be also applied to a direct injection system in which fuel is directly injected into a combustion chamber.

The fuel injection valve 1 is mainly composed of a housing pipe 2, a resin mold 3, a body valve 6 and an injection hole plate 7.

The housing pipe 2 is formed in shape of a cylinder extending axially, that is, in a pipe shape, is composed of a fixed core 20, a non-magnetic member 21 and a magnetic member 22, which are axially arranged in order from an upper side to a down side. Each inner diameter of the non-magnetic member 21 and the magnetic member 22 is larger than an inner diameter of the fixed core 20A so that a step 23 is formed at a boundary between the fixed core 20 and the non-magnetic member 21. A stopper ring 28, which has a fuel bore 280 penetrating up and down, is arranged at a lower inner circumference of the magnetic member 22.

An upper end of the fixed core 20 is inserted via an O-ring 24 into a lower inner circumference of a delivery pipe (not shown). A fuel filter 25 for filtering impurity contained in the fuel supplied from the delivery pipe is arranged at an upper inner circumference of the fixed core 20. An adjusting pipe 26 is arranged at a middle inner circumference of the fixed core 20.

The non-magnetic member 21 is positioned below the fixed core 20. A moving member 4 axially movable reciprocatingly is arranged below the step 23, which is formed by the fixed core 20 and the non-magnetic member 21. The moving member 4 is composed of a moving core 40 and a valve needle 41. The valve needle 41 is composed of an insertion end 43, a rod 44, a shoulder 45 and a valve 46.

The moving core 40, which is formed in a hollow cylindrical shape, is slidably in contact with a guide surface 29 constituting an inner circumference of the non-magnetic member 21. The moving core 40 is provided at an upper opening thereof with a step that retains a lower end of a spring 27. A lower end of the adjusting pipe 26 retains an upper end of the spring 27. That is, the spring 27 is sandwiched between the adjusting pipe 26 and the moving core 40 and biases the moving core 40 downward.

The insert end 43 of the valve needle 41 is inserted into and bonded to a lower opening 42 of the moving core 40. Cross sectional shape of the lower opening 42 is circular. On the other hand, cross sectional shape of the insert end 43 is nearly rectangular. Two surfaces of the insert end 43 diagonally positioned in a long side direction of the rectangular are bonded to an inner circumference of the lower opening 42. A gap between the circular lower opening 42 and the rectangular insert end 43 constitutes fuel passages.

The rod 44 extends downward from a lower end of the insert end 43. The shoulder 45, which is cylindrical, is positioned below the rod 44. The stopper ring 28 is arranged above the shoulder 45. The valve 46, which is positioned below the shoulder 45, is provided at a lower end thereof with a taper portion whose diameter is smaller downward.

The body valve 46, which is bonded to the magnetic member 22, is arranged around the shoulder 45 and the valve 46. As shown in FIG. 2, the body valve 6 is formed in a hollow cylindrical shape. A bottom wall 61 of the body valve 6 has a taper portion, whose diameter is smaller downward, constituting a valve seat 60. A cylindrical side wall 63 extends upward from a circumferential periphery of the bottom wall 61. An upper end of the side wall 63 is press fitted into and bonded by laser welding to the inner circumference of the magnetic member 22. A bonding portion 62 of the laser welding is formed in a ring shape. A groove 65, whose cross sectional shape is one side opened square, is formed at a lower outer circumference of the cylindrical side wall 63 below the bonding portion 62. The groove 65 is formed, just after the body valve 6 has been forged, by machining the outer circumference of the side wall 63. However, the groove 65 may be formed at the same time when the body valve 6 is forged.

The injection hole plate 7, which is shaped a cup, is bonded to a lower end of the body valve 6. The injection hole plate 7 is provided at a bottom thereof with injection holes 70 communicating with a lower opening of the body valve 6.

The resin mold 3 surrounds an outer circumference of the housing pipe 2. The resin mold 3 is composed of a spool 30, a coil 31 and a magnetic plate 32, which are coaxially arranged in order from radially inside to outside and formed in a ring shape. Further, the resin mold 3 is provided with a connector 33 protruding radially. The connector 33 has a terminal 34 through which an electric signal is transmitted from an electric control unit (not shown) to the coil 31.

An operation of the fuel injection valve 1 is described below. The fuel supplied from the delivery pipe is filtered at first by the fuel filter 25 and, then, passes through respective inner circumferences of the fixed core 20, adjusting pipe 26 and spring 27. Further, the fuel passes through the fuel passages between the lower opening 42 and the insert end 43 and, after passing through the fuel bore 280 of the stopper ring 28, flows into a gap between an outer circumference of the valve 46 of the valve needle 41 and an inner circumference of the body valve 6.

Upon applying the electric signal to the coil 31 through the terminal 34 for fuel injection control, a magnetic circuit, which constitutes a closed loop starting from the magnetic plate 32 and retuning thereto via the fixed core 20, the moving core 40 and the magnetic member 22, is produced around the coil 31. This magnetic circuit causes a magnetic attracting force that attracts the moving core 40 toward the fixed core 20. Accordingly, the moving core 40 is moved toward the fixed core 20 against a biasing force of the spring 27 so that the valve 46 of the valve needle 41 moves upward away from the valve seat 60. The valve needle 41 stops at a position where the shoulder 45 comes in contact with the stopper ring 28. When the electric signal applied to the coil 31 is shut off, the magnetic attracting force attracting the moving core 40 toward the fixed core 20 disappears so that the valve 46 of the valve needle 41 is again seated on the valve seat 60 by the biasing force of the spring 27.

Next, a detail of the laser welding by which the housing pipe 2 and the body valve 6 is bonded to each other is described below. The laser beam, which is amplified by YAG laser oscillator, is radiated from the outer circumferential side of the magnetic member 22 whose inner circumference closely accommodates the body valve 6. The laser beam is radiated to draw a circle along the outer circumference of the magnetic member 22. Thus, the welding heat is generated so as to draw a circle as a spot to which the laser beam is radiated is moved annularly. Accordingly, the body valve 6 in a vicinity of the bonding portion 62 is deformed. However, the deformation of the body valve 6 in the vicinity of the bonding portion 62 is hardly transmitted to the valve seat 60 due to the groove 65, which results in a less deformation of the valve seat 60.

Further, the groove 65 prevents the welding heat generated at the bonding portion 62 from transferring in straight line to the valve seat 60, since heat conductivity of an air layer existing in the groove 65 is remarkably lower than that of the body valve 6 that is made of metal such as stainless steel so that the welding heat is obliged to bypass the groove 65. This will also to lower the deformation of the valve seat 60. Instead of the air layer, the groove 65 may be filled with ring shaped resin foam, heat insulator, whose resiliency is lower than that of the body valve 6.

Moreover, the body valve 6 is press fitted to the inner circumference of the magnetic member 22 of the housing pipe 2 so that the upper end of body valve 6 may be incidentally deformed. However, the groove 65 also serves to absorb the deformation of the upper end of the body valve due to the press fitting not to transmit straight to the valve seat 60 since a bottom wall of the groove 65 is operative like a plate spring. Accordingly, the dimensional accuracy of the valve seat 60 is not lowered so much.

Further, if the groove 65 is located near the bonding portion 62, a deformation area of the upper end of the body valve 6 above the groove 65 is relatively small so that the groove 65 may effectively absorb the deformation.

The cross sectional shape of the groove 65 is not limited to the one side opened square but may be any shape such as a letter V having no bottom wall, unless the groove 65 is too large to maintain required strength of the body valve 6 and too small to lower the dimensional accuracy of the valve seat 60.

Figure 3:
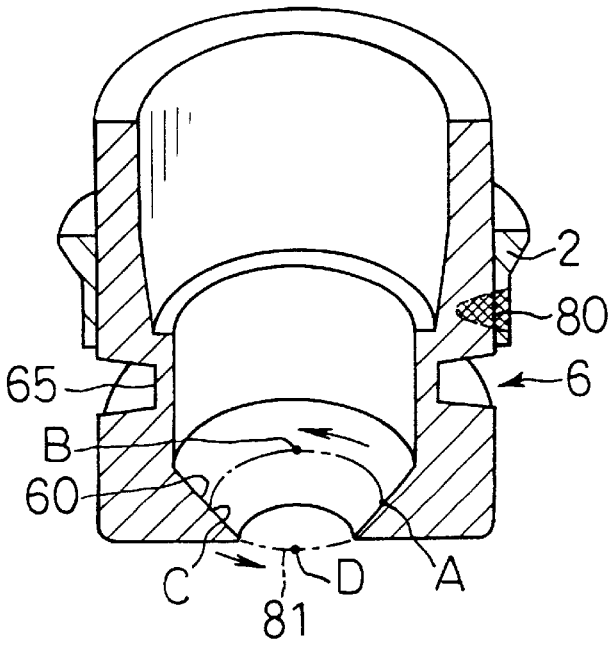
FIG. 3 is a cross sectional view of a part of a fuel injection valve for FEM analysis.

FEM analysis and Simulation results thereof with respect to the deformation of the valve seat 60 caused by the welding are described with reference to FIGS. 3 to 5. Both of circumferential displacement and axial displacement of points A, B, C and D in FIG. 3, that is, deformation amounts of these points, are calculated by the FEM analysis in a case that the laser beam is radiated to a single point for a purpose of brevity. The points A to D are points on a hypothetical ring 81 (shown in one dot-slash line in FIG. 3) circling along a circumference of the valve body 60. A bonding portion 80 is the one point to which the laser beam is radiated. The point A is located on a line radially connecting between an axis of the hypothetical ring 81 and the bonding portion 80 and an angle of the point A is set circumferentially zero (0). The points B, C and D are spaced circumferentially in the hypothetical ring 81 by 90, 180 and 270 degrees from the point A, respectively.

Figure 4:
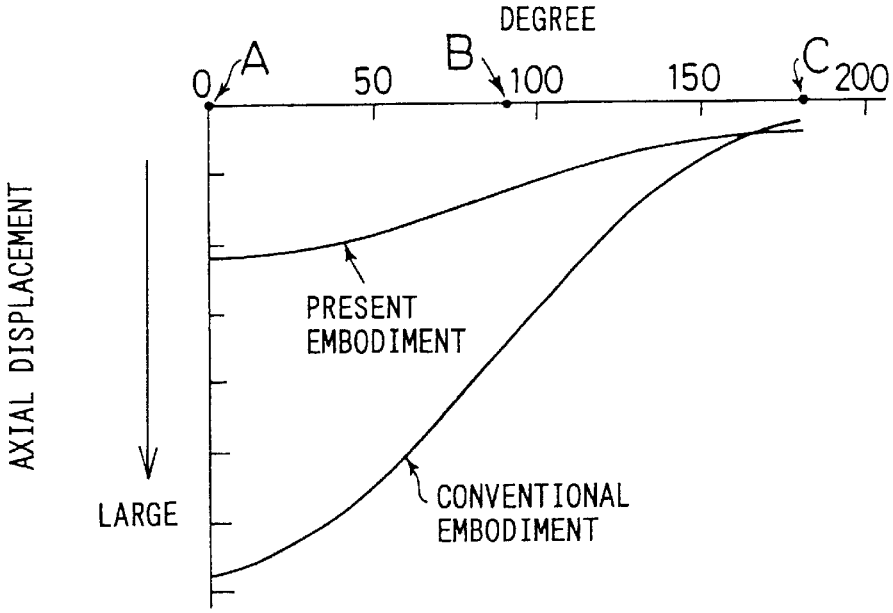
FIG. 4 is a chart showing an axial displacement of a valve seat as a result of the FEM analysis.

In FIG. 4, the axial displacement downward in an axial direction of the hypothetical ring 81 is set to minus (−) and the axial displacement upward therein is set to plus (+). In FIG. 5, the radial displacement in a direction of expanding the radius is set to plus (+) and the radial displacement in a direction of reducing the radius is set to minus (−).

Figure 5:
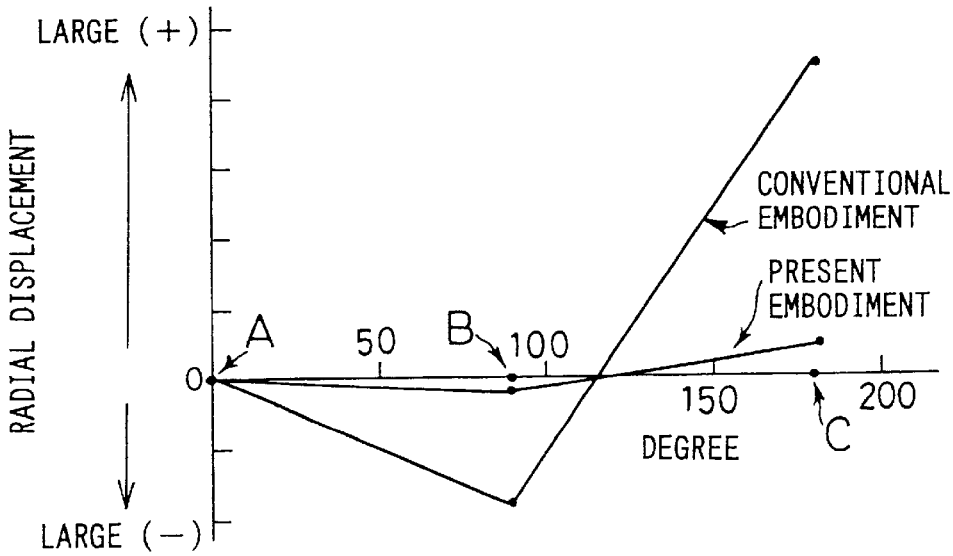
FIG. 5 is a chart showing radial displacement of a valve seat as a result of the FEM analysis.
Figure 6:
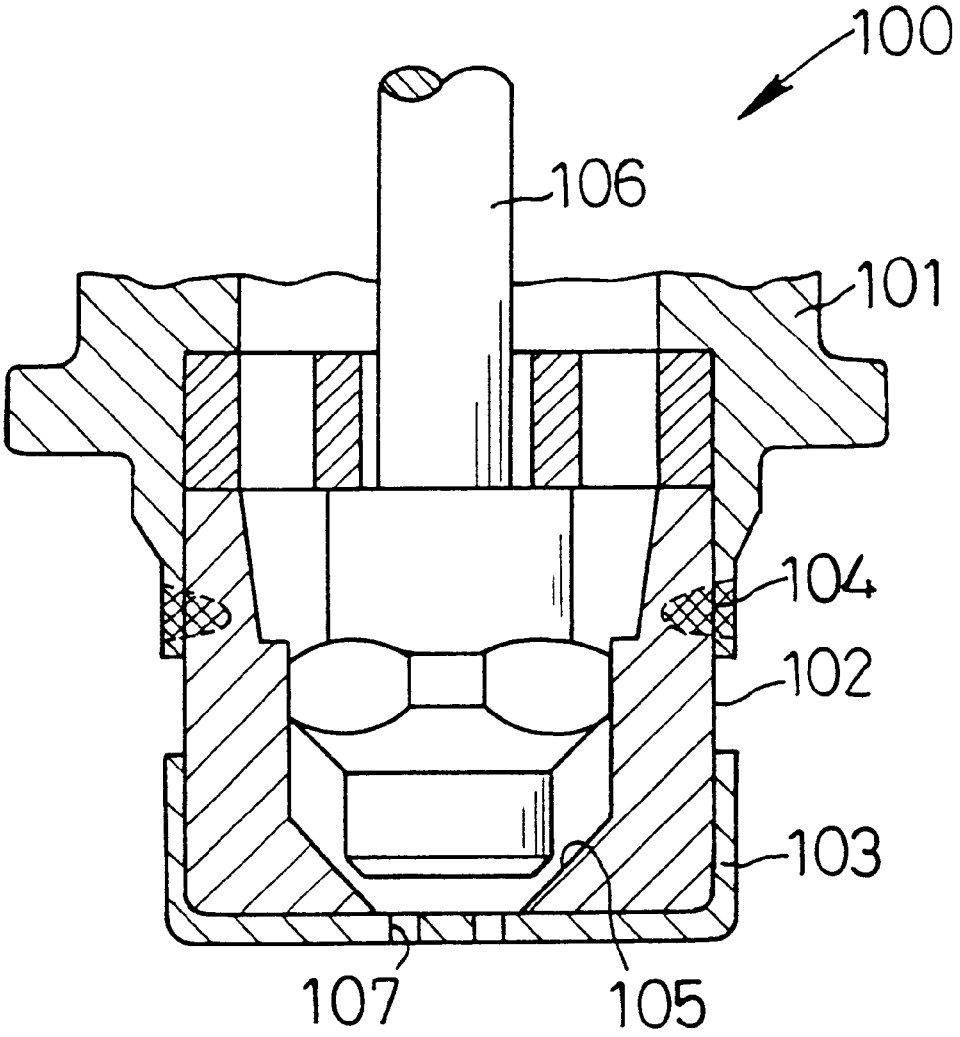
FIG. 6 PRIOR ART
FIG. 6 is a partly enlarged view of a conventional fuel injection valve as a prior art.

FIGS. 4 and 5 show only the displacements of the points A, B and C, under a comparison of the present embodiment with the conventional embodiment having no groove 65.

As illustrated in FIGS. 4 and 5, each of the axial and radial displacements of the present embodiment, that is, deformation thereof, is smaller than that of the conventional embodiment.

What is claimed is:

1. A fuel injection valve comprising:

a housing pipe;

a body valve movable reciprocatingly and axially inside the housing pipe; and a body valve having a bottom wall constituting a valve seat with which the valve comes in contact and a side wall whose axial end is connected to a circumferential periphery of the bottom wall and the other axial end is fitted to and heat bonded to an end of the housing pipe, the side wall being provided midway between the axial end and the other axial end thereof with a recess that is formed in advance before the body valve and the housing pipe are heat bonded to each other and serves to prevent a deformation of the side wall due to heat generated by the heat bonding from being transmitted straight to the valve seat;

wherein at least a part of the side wall of the body valve is exposed outside of the housing pipe, and the recess is formed on the side wall of the exposed part of the body valve so that the recess is not covered by the housing pipe.

2. A fuel injection valve according to claim 1, wherein the recess is a ring shaped groove formed on an outer circumference of the side wall.

3. A fuel injection valve according to claim 2, wherein the ring shaped groove is located in a vicinity of a place where the body valve and the housing pipe are heat bonded to each other.

4. A fuel injection valve according to claim 1, wherein the heat bonding is performed by welding.

5. A fuel injection valve according to claim 1, further comprising an injection hole plate which is separate from the body valve.

6. A fuel injection valve according to claim 5, wherein the injection hole plate has generally a cup-shaped cross section and surrounds the side wall of the body valve located at an injection hole side.

7. A fuel injection valve according to claim 6, wherein the recess is formed between a top end of a part of the injection hole plate surrounding the side wall of the body valve and the end of the housing pipe heat bonded to the body valve.

* * * * *